United States Patent [19]

Masuda et al.

[11] 4,436,167

[45] Mar. 13, 1984

[54] METHOD OF EXCAVATING A PILE HOLE AND AN APPARATUS THEREFOR

[75] Inventors: Masakazu Masuda, Sakai; Hironori Matsumoto, Amagasaki, both of Japan

[73] Assignee: Okumura Corporation, Osaka, Japan

[21] Appl. No.: 249,236

[22] Filed: Mar. 30, 1981

[51] Int. Cl.[3] ..... E21B 10/32

[52] U.S. Cl. ..... 175/72; 175/269; 175/285; 175/213

[58] Field of Search ..... 175/72, 266, 267, 269, 175/284, 285, 291, 213, 215

[56] References Cited

U.S. PATENT DOCUMENTS

| | | | |
|---|---|---|---|
| 2,457,628 | 12/1948 | Baker | 175/267 |
| 2,699,921 | 1/1955 | Garrison | 175/267 |
| 3,126,065 | 3/1964 | Chadderdon | 175/269 |
| 3,195,661 | 7/1965 | Jackson et al. | 175/215 |
| 4,134,619 | 8/1982 | Bunnelle | 175/215 |
| 4,278,137 | 7/1981 | Van Eak | 175/267 |

FOREIGN PATENT DOCUMENTS

| | | | |
|---|---|---|---|
| 1212900 | 3/1966 | Fed. Rep. of Germany | 175/285 |

*Primary Examiner*—Stephen J. Novosad
*Assistant Examiner*—William P. Neuder
*Attorney, Agent, or Firm*—Wenderoth, Lind & Ponack

[57] ABSTRACT

A method and an apparatus for excavating pile holes of various shapes, including a pile hole with a widened bottom and a pile hole with a widened top and widened bottom, by means of an excavating bit and widening bits.

14 Claims, 6 Drawing Figures

METHOD OF EXCAVATING A PILE HOLE AND AN APPARATUS THEREFOR

BACKGROUND AND SUMMARY OF THE INVENTION

This invention relates to an apparatus for excavating a pile hole. The present invention has for an object to provide an excavating apparatus which makes it possible to construct at cheaper cost cast-in-place concrete piles of large calibre and long length having high horizontal and vertical bearing strength, which apparatus widens the upper part or top end portion of a pile. Although several methods of excavating bottom-widened pile holes by using a reverse circulation drilling system have been developed for the above purpose, such methods have the following problems.

(1) The excavating apparatus is complicated. Complexity of the apparatus causes more trouble and results in higher cost.

(2) The bottom-widened pile holes are uniform in shape.

(3) More time is required to operate the excavator.

(4) Forming of the foundation at the pile bottom part and sweeping of soil and sand at the pile bottom are not satisfactory.

(5) Removing of slime is unsatisfactory.

(6) Precision of measuring the depth of pile hole (pile length) is poor.

(7) Bearing strength at the top part of the pile can be increased but it is impossible to construct piles of this type which can cope with the bending moment generated by a horizontal external force originating from an earthquake or the like.

In view of the above disadvantages of the conventional methods of excavating bottom-widened pile holes, the present invention has been developed to make it possible to carry out a novel method of excavating bottom-widened pile holes by a reverse circulation drilling system.

BRIEF DESCRIPTION OF THE DRAWINGS

The nature and advantages of the present invention will be understood more clearly from the following description of preferred embodiments, which description is taken with the accompanying drawings, in which.

DETAILED DESCRIPTION OF THE INVENTION

Figure 3:
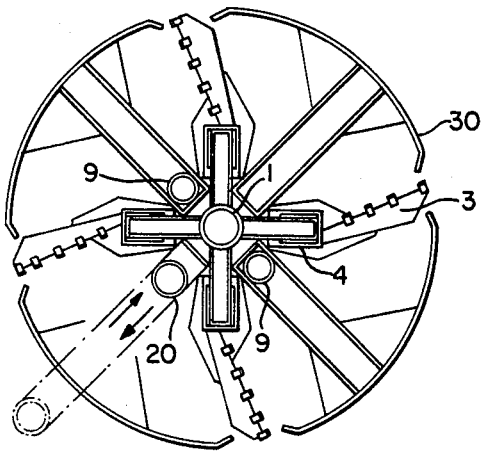
FIG. 3 is a cross-sectional view, taken along the line III—III in FIG. 2.
Figure 2:
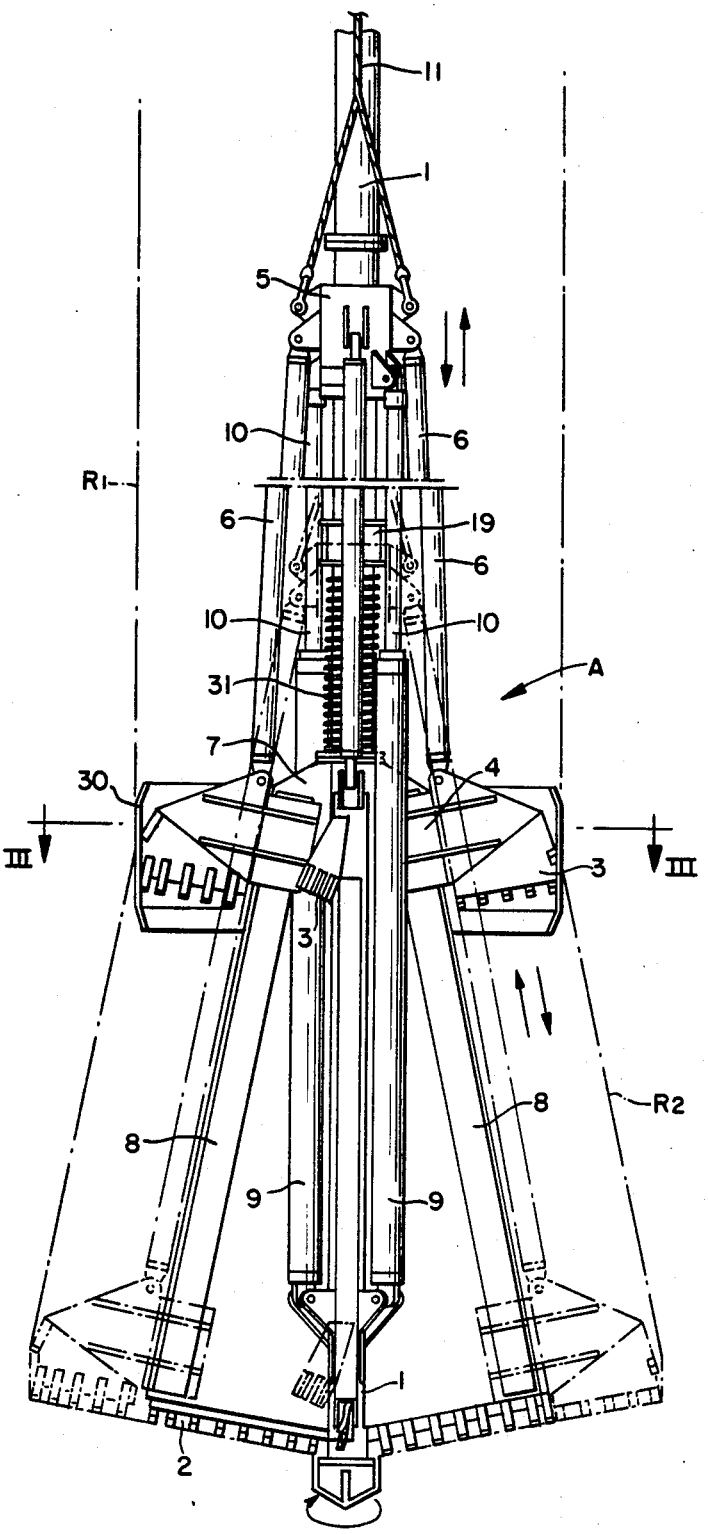
FIG. 2 is a front elevation view of the main part of an excavating apparatus according to the present invention.
Figure 4:
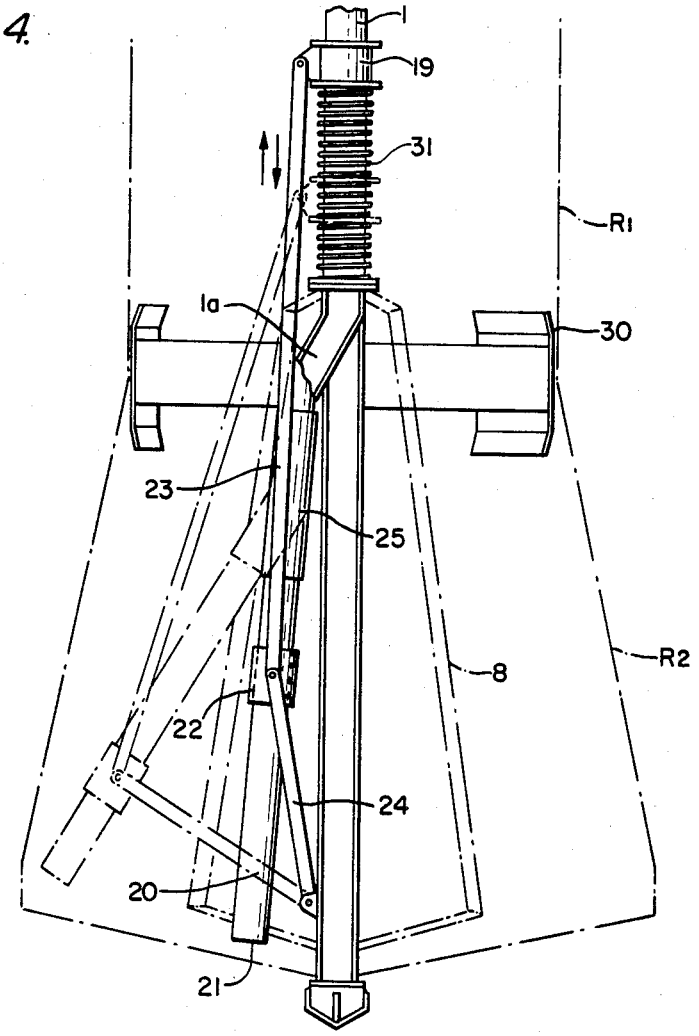
FIG. 4 is a schematic elevation view showing the operation of a suction pipe.

FIGS. 2–4 show an excavating apparatus according to the present invention for excavating pile holes. The excavating apparatus has a hollow drill pipe 1 of the required length and rotated around its axis by a proper driving device, not shown in the drawing. The pipe 1 has at the lower end thereof an excavating bit 2 for excavating a pile hole R1 of the required diameter. Excavated soil and sand are discharged above the ground, together with slurry, by a known means.

A plurality (four, for example, as shown in the drawing) of bits 3 for widening are provided around the lower end of the drill pipe 1 at arbitrary intervals. Each bit 3 is fixed to the lower end of a push rod 6 which is supported at the top end thereof by a push ring 5 slidably fitted on the drill pipe 1. Each bit 3 is movable along a bottom widening guide 8 which is fitted between a fixed ring 7 fixed to the drill pipe 1 and a proper place at the outer end of the excavating bit 2. The guide 8 is tapered toward its upper end so that it can be kept within the pile hole R1 when the excavating of the pile hole R1 by means of the excavating bit 2 is in progress but is wider toward its lower end so that the required bottom-widened pile holes R2, R3 and R4 can be formed when the bits 3 for widening are lowered along the guides 8.

Each bit 3 is provided with a sliding member 4 having a U-shaped cross sectional shape for guiding the bit 3 along the guide 8, but the sliding member is not necessarily limited to the above shape.

The push ring 5 is moved up and down by a proper driving device, for example, by hydraulic cylinders 9 in this embodiment. Each hydraulic cylinder 9 is supported slidably at the tail end thereof by the drill pipe 1 and the piston rod 10 thereof is connected at the top end thereof to the push ring 5. The hydraulic cylinders 9 are operated from above the ground. The bits 3 are lowered along the guide 8 by moving push ring 5 down which moves the push rods 6, thereby moving the bits 3 downward and outward in the radial direction.

In place of each hydraulic cylinder 9, a threaded rod which is almost in parallel with the drill pipe 1 can be used for the same purpose. In this case, the threaded rod is threaded to the push ring 5 and is driven by an electric motor.

The push ring 5 is provided with a detecting means 11 to indicate the extent of lowering. The detecting means 11 shown in FIG. 2 is a wire rope but the wire rope may be replaced by a chain or a rod, or detection can be made by measuring the flow rate of liquid in the hydraulic cylinder.

The excavating device A has a movable suction pipe 20 (FIG. 4) for removing soil and sand excavated by bits 3. The suction pipe 20 is supported slidably by a support pipe 22 which pivotally supports one end of an upper bar 23, the other end of which is pivotally supported on a receiving ring 19 movable up and down on the drill pipe 1, and also pivotally supports one end of a lower bar 24, the other end of which is pivotally supported on the drill pipe 1 at a proper lower part thereof. The upper end of the suction pipe 20 is connected to a branch pipe 1*a* branched from the drill pipe 1 through the medium of a flexible pipe 25. The lower suction end 21 of the suction pipe 20 is moved radially in proportion to the amount the push ring 5 is lowered, by the link motion of bars 23 and 24. Thus, during the rotation of the drill pipe 1, slime at the pile hole bottom is suctioned accurately and the bottom of the pile hole is swept.

In the embodiments shown in FIG. 2–FIG. 4, the suction pipe 20 is moved in synchronism with bits 3 but this synchronization is not necessarily required and the suction pipe 20 can reciprocate separately from the bits 3. For example, in FIG. 4 either of the upper and lower bars which support the support pipe 22, for example, the lower bar 24, can be replaced by a screw system, namely, a female threaded member driven by a hudraulic cylinder, an electric motor, oil pressure or the like, is threaded to a male threaded member and by turning the female member the male member is caused to advance and retract. Under this arrangement, the bar 24 is expanded or contracted and thus the suction pipe 20 reciprocates. Alternatively, a base end of a hydraulic cylinder is supported at a proper place on the upper part of the drill pipe 1, omitting the upper bar 23, and the free end of the piston rod thereof is connected to the support pipe 22 so that the suction pipe can be reciprocated in concert with the lower bar 24. Another means of reciprocating the suction pipe 20 radially is available, that is, the support pipe 22 is given the required weight and one end of a wire or a chain is connected to said support pipe, omitting the upper bar 23. By letting down said wire or chain by the operation of an electric motor or the like installed on the ground, the support pipe 22 is lowered due to its own weight along the suction pipe 20 and at the same time it turns around the pin connection of the lower bar 24 to the drill pipe 1 as center, and thus the suction pipe is reciprocated radially by repeating pulling up and down of said wire or chain, irrespective of the movement of the bits 3. Any of these means can be adopted as desired, without departing from the principle of the present invention.

Figure 5:
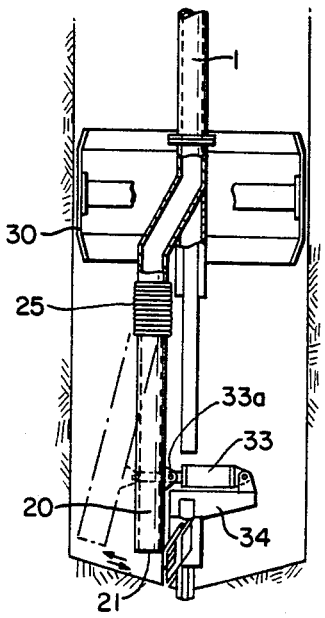
FIG. 5 is an elevation view, partly in section, of a different embodiment of the suction pipe.
Figure 6:
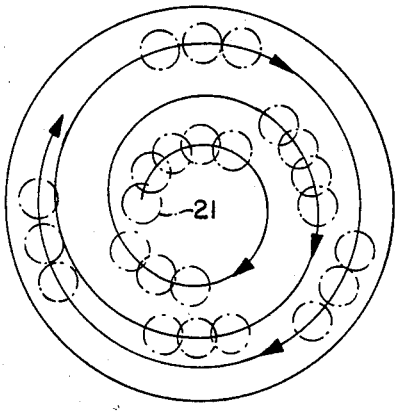
FIG. 6 is a schematic view showing the locus of movement of the suction pipe shown in FIG. 4 and FIG. 5.

FIG. 5 shows an embodiment using a different swinging system for the suction pipe 20. In this embodiment, a flexible hose 25 protrudes from the lower part of the drill pipe 1 and has a suction pipe 20 connected thereto having a length such that the required gap is provided between the end 21 of the suction pipe and the bottom surface of the excavated hole. A hydraulic cylinder, a motor-operated cylinder or the like 33 is provided on a bracket 34 on a protruding part of the drill pipe 1 and a rod 33*a* of said cylinder is fixed to a part of the suction pipe 20. By operating the hydraulic cylinder 33 from above the ground, the suction pipe 20 is moved in the radial direction of the excavated hole. In this case, if a reverse excavating machine is turned while moving the suction pipe radially, the working locus of the suction hole at the lower end of the suction pipe is as shown by FIG. 6, namely, the suction hole progresses toward the outer circumferential surface of the pile hole bottom in a helical path. Therefore, according to this apparatus, since the hydraulic cylinder is operated from above the ground so as to move the suction pipe 20 radially at all times, the suction hole at the lower end of the suction pipe covers all the hole bottom and the excavated soil is suctioned and discharged immediately. Moreover, this apparatus is applicable to any shape of hole bottom, irrespective of the tilt angle of the hole bottom, and the suction hole is not clogged with excavated oil, stone, etc. Thus, this apparatus improved excavating efficiency and ensures accurate removing of excavated soil and slime from the hole bottom, with the result that bearing power at the top end of the pile is stabilized. In the drawing, numeral 30 denotes a stabilizer having a diameter almost the same as that of the pile hole R1 or R2 and fitted to a fixed ring on the drill pipe 1 at a position below the receiving ring 19 in order to prevent deviation of the pipe during excavating. Numeral 31 (FIG. 4) denotes a spring for compensating for the deviation when the push ring 5 is lowered and for pushing the rods of the hydraulic cylinders 9 up by its repulsive force when the pressure to the hydraulic cylinders 9 is discontinued.

An outline of the method of excavating a pile hole which is widened at the bottom part by using the above-described excavating device A is given below.

The bits 3 are pushed by the hydraulic cylinder 9 up the tapered portion of the guide 8, namely, up to positions where they are not projected from the lower excavating bits 2 and are held there. By turning the drill pipe 1, a pile hole R1 of the required diameter is excavated by means of the excavating bits 2 and the excavated soil and sand are exhausted above the ground via the drill pipe 1. Excavation of the pile hole R1 is not limited to excavation by the above-described excavating device A but can be done by a conventional earth auger or the like. In the case of the excavating device A, it is inserted in the excavated hole R1 and excavation is carried out in such a manner that the angle of the hole bottom portion is near a flat plane. Upon completion of the excavation to the specified depth, excavation of the widened portion R3 of the pile hole is started.

As stated above, the hydraulic cylinders 9 are operated from above the ground while the rotation of the drill pipe 1 is maintained and the push ring 5 is lowered by the piston rods 10, whereby the bit 3 for widening lowers along the bottom widening guides 8 and move radially along the inclination of the guides 8 and thus excavating is carried out by the rotation of the drill pipe 1. The extent of radial movement of the bits 3, namely, the extent of lowering of the bits 3, is detected on the ground by a proper detecting means 11 such as a wire rope and when the bits 3 have been lowered to the lowest end of the guides 8, hydraulic pressure is stopped.

When the hydraulic cylinders 9 are operated by the hydraulic pressure and the push ring 5 is lowered down to the receiving ring 19 by the piston rods 10, the receiving ring 19 is lowered and compresses the spring 31. With the lowering of the receiving ring 19, the suction port 21 of the suction pipe 20 shifts laterally by the link motion of the upper bar 23 and the lower bar 24 and with the rotation of the drill pipe 1, the suction port 21 also moves spirally. Thus, excavated soil and sand are sucked up and removed completely, together with slurry, and excavating of bottom-widened pile hole is finished.

Upon finishing of the desired excavation, the push ring 5 is raised by operating the hydraulic cylinders 9 while continuing the rotation of the drill pipe 1 and the bits 3 are drawn up by the rods 6. At this time, the receiving ring 19 is pushed up, with the rising of the push ring 5, by repulsive force of the spring 31 and the suction pipe 20 shifts toward the axial center portion as it is sucking up the slime at the pile hole bottom and returns to its original state. The push ring 5 is pushed up further and the returning of the bits 3 to their original position is detected by the detecting means 11 and the hydraulic pressure is stopped.

According to the present invention, as the bits move radially and downwardly along the guides 8, a pile hole of widened diameter can be excavated exactly to the required measurements. Moreover, such measurements can be ascertained by the detecting means on the ground, and soil and sand excavated by the bits is discharged by the suction pipe 20. By swinging said suction pipe in a radial direction, remaining slime can be sucked up completely and thus sweeping of the bottom is carried out accurately, with the result that the widened-bottom pile hole can be filled with concrete completely without the mixing in of slime and the required bearing strength can be imparted to the top end portion of a pile.

Figure 1:
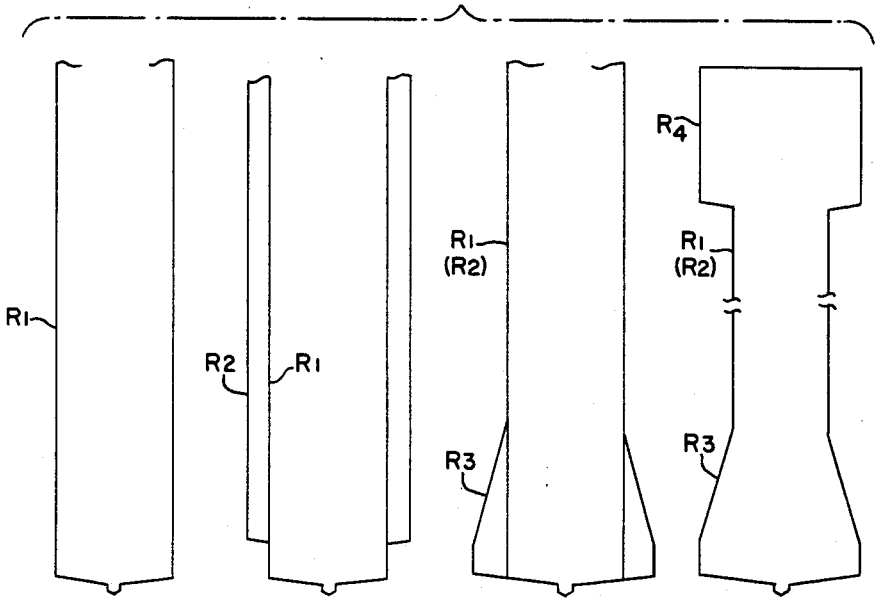
FIG. 1 is a diagram showing longitudinal sections of different pile holes which can be excavated by the apparatus according to the present invention.

The above description is of the method of excavating bottom-widened pile holes by firstly excavating soil and sand by using only an excavating bit and then lowering thebottom-widening bits downwardly and outwardly to the lower end of the excavating bit while continuing to drive the excavating bit to the lower end of the pile hole for widening the pile hole lower end portion by downwardly and outwardly flaring the walls in a conical shape from a point intermediate the depth of the pile hole to the bottom thereof, as shown by FIG. 1*c*. However, the longitudinal sectional shape of the pile hole which can be excavated by the apparatus according to the present invention is not limited to that shown by FIG. 1*c* but can be those shown by FIG. 1*a*, FIG. 1*b* and FIG. 1*d*. FIG. 1*a* shows the longitudinal section of a pile hole which can be excavated by using only an excavating bit. FIG. 1*b* shows the longitudinal section of a pile hole of a diameter R2 which can be excavated by keeping the widening bits in a proper position on the guides 8 from the start of the hole. In this case, free choice of the pile diameter can be made. FIG. 1*d* shows the longitudinal section of a pile hole having a larger diameter at the pile upper portion and a widened bottom portion at the pile lower portion and which is obtained by firstly keeping the bottom-widening bits at a lower position to excavate a hole of a larger diameter, secondly drawing up the bits at the desired depth, then continuing excavation at a smaller diameter and finally lowering the bottom-widening bits again to excavate bottom-widened pile hole. Since the pile hole thus excavated has a larger diameter at the upper portion, when a horizontal external force acts on a structure supported by the pile on the occurrance of an earthquake, for example, resistance to a bending moment generated in the pile is large, and also, because the lower part of the pile has a larger vertical force supporting area due to a widened bottom, the pile can bear a large vertical load. Moreover, since the intermediate part of the pile is smaller in diameter than the upper part and the lower part, less quantity of concrete is required than for a pile which can bear equal horizontal load and vertical load and thus less cost is required for constructing such a pile.

What is claimed is:

1. In a pile hole excavating method of excavating a pile hole of the required diameter by means of excavating bits fixed to the lower end portion of a rotary drill pipe and stabilizing the hole wall by filling the excavated pile hole with slurry, the improvement comprising firstly excavating a pile hole portion of a larger diameter down to the required depth by moving widening bits on the drilling apparatus to an extended position, drawing the widening bits in to a retracted position and excavating a pile hole portion of reduced diameter down to the required depth, moving the widening bits to the extended position and excavating a pile hole bottom of widened diameter for forming a pile hole with a larger diameter at the pile head and at the pile bottom, and finally sucking up and discharging the soil, sand, slime and slurry excavated by both bits and settled on the hole bottom by a suction pipe fixed to the rotary drill pipe.

2. An apparatus for excavating a pile hole, comprising:

a rotary drill pipe having excavating bit means on the lower end thereof for excavating a pile hole of the desired diameter;

downwardly extending straight guides mounted on the lower part of said rotary drill pipe and inclined outwardly to the axis of said drill pipe;

widening bits for excavating a pile hole of a diameter larger than that of the pile excavated by said excavating bit means and slidable along said guides from an upper position within the diameter of the desired diameter pile hole to a lower position where they project outwardly to the larger diameter pile hole;

driving means connected to the widening bits for driving them along said guides and supporting them in the lower position;

a suction pipe for sucking up and discharging the material excavated by said excavating bit means and said widening bits together with any surry, and having the lower end spaced slightly above the lower end of said excavating bit means; and a suction pipe shifting means connected to said suction pipe for moving the lower end of said suction pipe in a radial direction relative to said drill pipe along the bottom of the excavated pile hole, whereby when the lower end of said suction pipe is moved outwardly during rotation of said drill pipe, said lower end moves in a helical path to cover the entire areal of the bottom of the excavated pile hole.

3. An apparatus as claimed in claim 2 in which said guides are fixed, and the lower ends thereof are within the diameter of the desired diameter pile hole.

4. An apparatus as claimed in claim 2 in which the lower ends of said guides are adjacent said excavating bit means and said widening bits when they are at the lower ends of said guides have bottom profiles which are a continuation of the profile of said excavating bit means.

5. An apparatus as claimed in claim 2 further comprising a flexible hose connecting the upper end of said suction pipe and said drill pipe.

6. An apparatus as claimed in claim 2 wherein said shifting means comprises a support pipe slidable on said suction pipe, an upper bar having the upper end slidably mounted on said drill pipe and the lower end pivotally connected to said support pipe, and a lower bar having the outer end pivotally connected to said support pipe and the inner end pivotally connected to said drill pipe, and means for sliding the upper end of said upper bar up and down said drill pipe for swinging said suction pipe inwardly and outwardly relative to said drill pipe.

7. An apparatus as claimed in claim 2 wherein said shifting means comprises a bracket mounted on said drill pipe, a piston-cylinder device on said bracket and having a piston rod connected to said suction pipe for moving said suction pipe radially inwardly and outwardly relative to said drill pipe.

8. An apparatus for excavating a pile hole, comprising:

a rotary drill pipe having excavating bit means on the lower end thereof for excavating a pile hole of the desired diameter;

downwardly extending straight guides mounted on the lower part of said rotary drill pipe and inclined outwardly to the axis of said drill pipe;

widening bits for excavating a pile hole of a diameter larger than that of the pile hole excavated by said excavating bit means and slidable along said guides from an upper position within the diameter of the desired diameter pile hole to a lower position where they project outwardly to the larger diameter pile hole; and driving means connected to the widening bits for driving them along said guides and supporting them in the lower position.

9. An apparatus as claimed in claim 8 in which said guides are fixed, and the lower ends thereof are within the diameter of the desired diameter pile hole.

10. An apparatus as claimed in claim 8 in which the lower ends of said guides are adjacent said excavating bit means and said widening bits when they are at the lower ends of said guides have bottom profiles which are a continuation of the profile of said excavating bit means.

11. An apparatus for excavating a pile hole, comprising:

a rotary drill pipe having excavating bit means on the lower end thereof for excavating a pile hole of the desired diameter;

a suction pipe for sucking up and discharging the material excavated by said excavating bit means together with any slurry, and having the lower end spaced slightly above the lower end of said excavating bit means; and a suction pipe shifting means connected to said suction pipe for moving the lower end of said suction pipe in a radial direction relative to said drill pipe along the bottom of the excavated pile hole, whereby when the lower end of said suction pipe is moved outwardly during rotation of said drill pipe, said lower end moves in a helical path to cover the entire areal of the bottom of the excavated pile hole.

12. An apparatus as claimed in claim 11 further comprising a flexible hose connecting the upper end of said suction pipe and said drill pipe.

13. An apparatus as claimed in claim 11 wherein said shifting means comprises a support pipe slidable on said suction pipe, an upper bar having the upper end slidably mounted on said drill pipe and the lower end pivotally connected to said support pipe, and a lower bar having the outer end pivotally connected to said support pipe and the inner end pivotally connected to said drill pipe, and means for sliding the upper end of said upper bar up and down said drill pipe for swinging said suction pipe inwardly and outwardly relative to said drill pipe.

14. An apparatus as claimed in claim 11 wherein said shifting means comprises a bracket mounted on said drill pipe, a piston-cylinder device on said bracket and having a piston rod connected to said suction pipe for moving said suction pipe radially inwardly and outwardly relative to said drill pipe.

* * * * *